US009867488B2

(12) United States Patent
Wright et al.

(10) Patent No.: US 9,867,488 B2
(45) Date of Patent: Jan. 16, 2018

(54) ARTHROGRYPOSIS MULTIPLEX CONGENITA LIFESTYLE AND GROOMING TOOL

(71) Applicants: Ian Michael Wright, Loveland, OH (US); Deborah Alisia Flaig, Cincinnati, OH (US)

(72) Inventors: Ian Michael Wright, Loveland, OH (US); Deborah Alisia Flaig, Cincinnati, OH (US)

(73) Assignee: Ian Michael Wright, Loveland, OH (US)

( * ) Notice: Subject to any disclaimer, the term of this patent is extended or adjusted under 35 U.S.C. 154(b) by 0 days.

(21) Appl. No.: 15/088,255

(22) Filed: Apr. 1, 2016

(65) Prior Publication Data

US 2016/0288316 A1 Oct. 6, 2016

Related U.S. Application Data

(60) Provisional application No. 62/142,165, filed on Apr. 2, 2015.

(51) Int. Cl.

| | |
|---|---|
| ***A44B 19/00*** | (2006.01) |
| ***A47G 25/92*** | (2006.01) |
| ***A47G 25/90*** | (2006.01) |
| ***B26B 13/14*** | (2006.01) |
| ***B25F 1/00*** | (2006.01) |
| ***B25F 1/04*** | (2006.01) |
| ***B25C 1/04*** | (2006.01) |

(52) U.S. Cl.

CPC ..... *A47G 25/92* (2013.01); *A47G 25/902* (2013.01); *B25C 1/04* (2013.01); *B25F 1/003* (2013.01); *B25F 1/04* (2013.01); *B26B 13/14* (2013.01); *A47G 2200/046* (2013.01)

(58) Field of Classification Search

CPC ..... B25J 1/04; A47G 25/902; A47G 25/92; A47G 2200/046; B26B 13/14; B25F 1/003; B25F 1/04; B25G 1/04

See application file for complete search history.

(56) References Cited

U.S. PATENT DOCUMENTS 3,960,021 A * 6/1976 Jones ..... G01N 1/12 294/99.1
4,240,658 A * 12/1980 Britson ..... B25J 1/04 294/175
5,202,094 A * 4/1993 Jones ..... A47G 23/0216 16/111.1

(Continued)

*Primary Examiner* — Stephen A Vu
(74) *Attorney, Agent, or Firm* — Taft Stettinius & Hollister LLP; Derek Lavender

(57) ABSTRACT

A tool assembly having a housing body with a top portion and a bottom portion. The tool assembly may have an axis defined by the housing body and extending through the top portion and the bottom portion, an opening defined in the housing and extending from an outer surface of the housing body towards the axis, a notch defined in the housing along the opening, and a module base having a collar. Wherein the module base is positionable within the opening and when the collar is at least partially positioned within the notch, the module base is at least partially positioned within the opening and restricted from moving axially along the axis relative to the housing body.

19 Claims, 8 Drawing Sheets

(56) References Cited

U.S. PATENT DOCUMENTS

| | | | | |
|---|---|---|---|---|
| 5,749,497 | A * | 5/1998 | Davis | B65D 25/22 215/399 |
| 6,196,403 | B1 * | 3/2001 | Yamaguchi | B65D 23/104 215/396 |
| 8,522,997 | B2 * | 9/2013 | Lane | B65D 39/08 220/375 |

* cited by examiner

ARTHROGRYPOSIS MULTIPLEX CONGENITA LIFESTYLE AND GROOMING TOOL

RELATED APPLICATIONS

The present application claims the priority of U.S. Provisional Application No. 62/142,165, filed Apr. 2, 2015, the disclosure of which is hereby incorporated by reference in its entirety.

FIELD OF THE DISCLOSURE

The present disclosure relates to a tool assembly, and more specifically to a tool assembly that selectively receives a tool.

BACKGROUND OF THE DISCLOSURE

Arthrogryposis Multiplex Congenita ("AMC") is a condition that causes a person's joints to be stiff and/or crooked. A person with AMC, or any other condition that causes similar stiff and crooked joints, may have difficulty executing routine motions because of their condition. Accordingly, different types of tools are used by people with joint conditions to assist them in executing routine activities such as fastening a zipper or button, eating, writing, cutting paper, or the like. However, these tools are often cumbersome, not easily interchangeable, and difficult to use.

Accordingly, there is a need for a tool assembly that can easily be manipulated by a user to select multiple different tool heads wherein each tool head aids the user in executing the desired activity.

SUMMARY

In one embodiment a tool assembly includes a housing body having a top portion and a bottom portion, an axis defined by the housing body and extending through the top portion and the bottom portion, an opening defined in the housing and extending from an outer surface of the housing body towards the axis, a notch defined in the housing along the opening, and a module base having a collar. The module base is positionable within the opening. When the collar is at least partially positioned within the notch, the module base is at least partially positioned within the opening and restricted from moving axially along the axis relative to the housing body.

One example includes a seat defined by the housing body as part of the opening, the seat being encompassed by the housing body except along the axis towards the top portion. Further, a terminus is defined by the module base, wherein when the collar is at least partially positioned within the opening and the terminus is positioned within the seat. The terminus is substantially restricted from moving relative to the housing. The module base, in one embodiment, includes a substantially cylindrical shaft extending between the terminus and the collar. Further, the terminus has an expanded end with a second maximum width, wherein, when the terminus is positioned within the seat, the expanded end interferes with the seat to substantially restrict the module base from rotating along the axis relative to the housing body.

In another example, a keyhole is defined in the module base at a terminus.

In another example, a tool is coupled to the base module, wherein the tool is one of a knife, a zipper hook, scissors, a button hook assembly, or a snap assembly.

Another embodiment may be a tool assembly for removably coupling a tool to a base having a housing defining an axis that extends longitudinally through a top and a bottom of the housing. An opening is defined in the housing biased towards the top. A receiver is defined by the housing between the opening and the bottom. A notch is defined in the opening between the receiver and the top, and a tool having a module base defines a collar and a terminus, wherein, the terminus corresponds in size with the receiver. In one embodiment, the collar is positionable at least partially within the notch, further wherein, when the collar is at least partially within the notch and the terminus is at least partially within the receiver, the tool is restricted from moving axially along the axis relative to the housing.

In one example, the terminus defines a keyhole.

In another embodiment, the terminus is at least partially located within the receiver and the module base does not rotate about the axis relative to the housing.

In yet another example, a strap is selectively positionable across the opening.

In another example, the terminus is positioned at least partially within the receiver before the collar is positioned at least partially within the notch to couple the tool to the housing within the opening.

In another example, one or more strap connection is coupled to the housing and the strap connection provides a coupler location for one or more straps.

In another example the tool defines the module base on one side, and a button module on the other side. The button module includes an outer sleeve coupled to the base module and a front track and a rear track are defined through the outer sleeve. An inner sleeve is sized to be slidably positioned within the outer sleeve. An elongated through-hole is defined through a portion of the inner sleeve and an eyelet is coupled to the inner sleeve. A pin is positioned through the front track, the elongated through-hole, and the rear track. A finger hook is coupled to one end of the pin, wherein, the finger hook is adapted to move the pin along the first track and the second track.

In another embodiment, a tool for positioning a button through a button hole is provided. The tool includes a base module on one side and a button module on the other side. An outer sleeve is coupled to the base module and a front track and a rear track are defined through the outer sleeve. An inner sleeve is sized to be slidably positioned within the outer sleeve and an elongated through-hole is defined through a portion of the inner sleeve. An eyelet is coupled to the inner sleeve. A pin is positioned through the front track, the elongated through-hole, and the rear track. A finger hook is coupled to one end of the pin, wherein, the finger hook is adapted to move the pin along the first track and the second track.

One example includes an axis defined through the base module, the outer sleeve, and the inner sleeve. Further, the inner sleeve moves axially along the axis relative to the outer sleeve until the pin contacts an upper wall or a lower wall of the elongated through-hole.

In another example, as the pin moves along the first track and the second track, the inner sleeve rotates about the axis.

In another example the eyelet outlines a large diameter through-hole coupled to small diameter through-hole, wherein the large diameter through-hole is adapted to fit around a button and the small diameter through-hole is adapted to become positioned underneath the button.

In another example, the base module includes a housing body having a top portion and a bottom portion, an axis defined by the housing body and extending through the top portion and the bottom portion, and an opening defined in the housing and extending from an outer surface of the housing body towards the axis. A notch is defined in the housing along the opening. A module base includes a collar, wherein, the module base is positionable within the opening and further wherein, when the collar is at least partially positioned within the notch, the module base is at least partially positioned within the opening and restricted from moving axially along the axis relative to the housing body.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
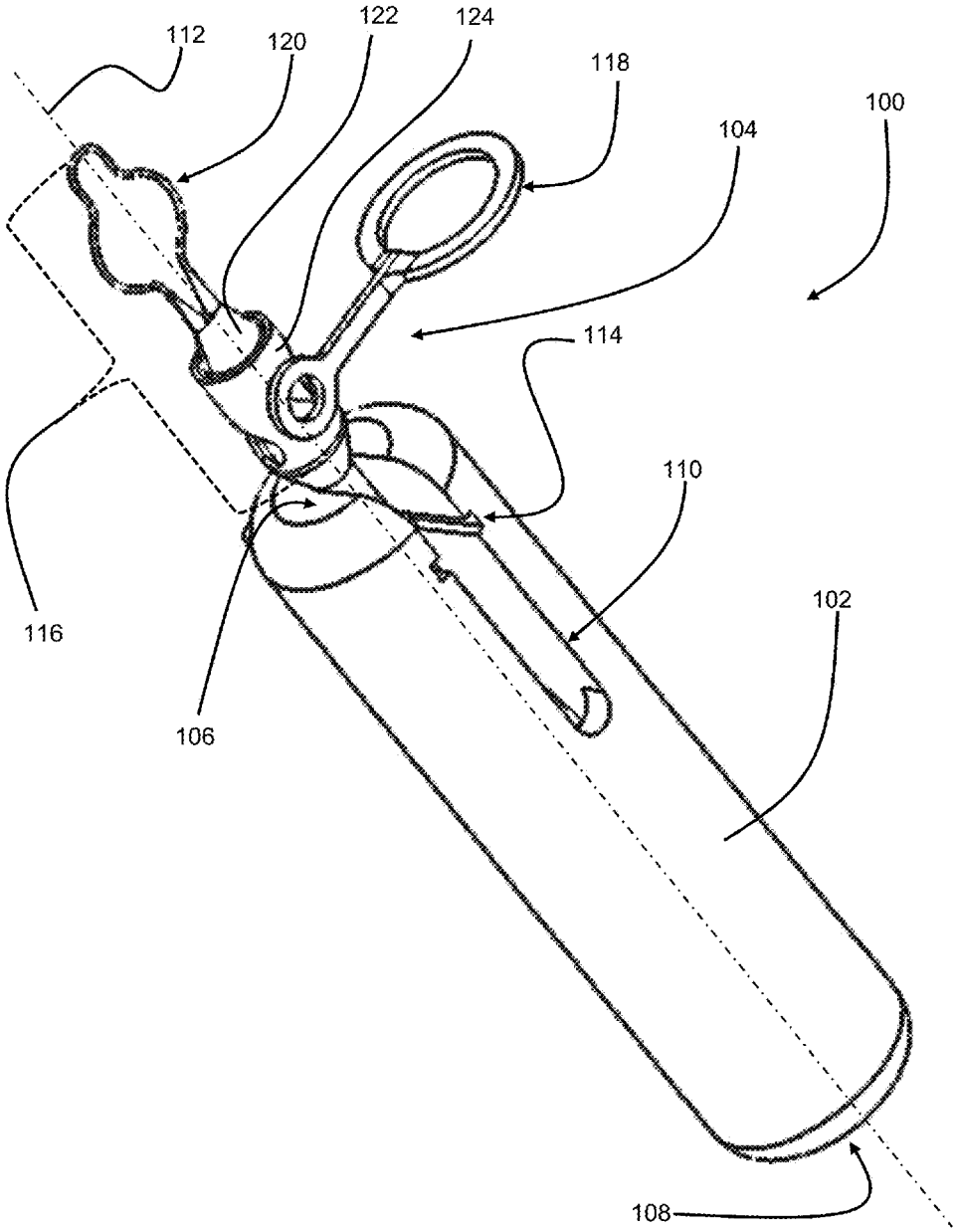
FIG. 1 is an elevated perspective view of a tool assembly.
Figure 8:
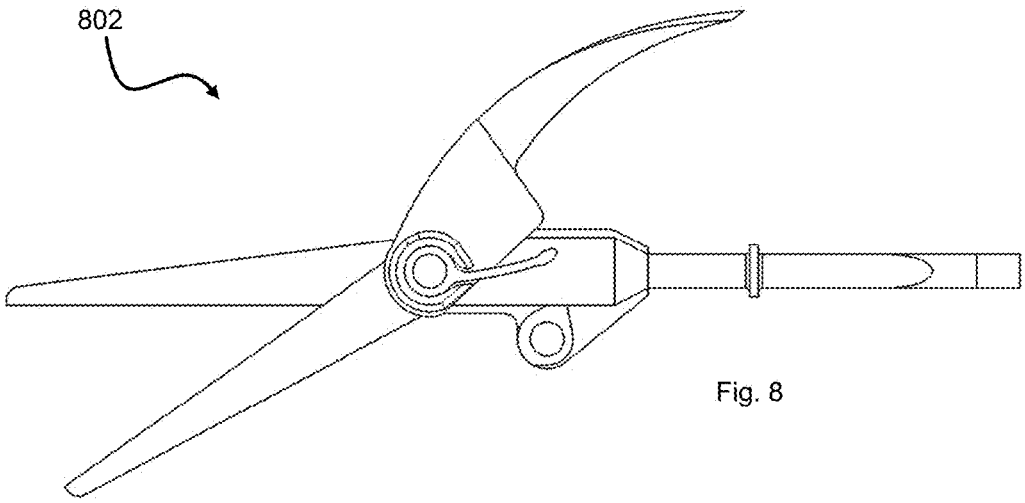
FIG. 8 is a side view of a scissor tool that can be coupled to the housing of FIG. 4.
Figure 9:
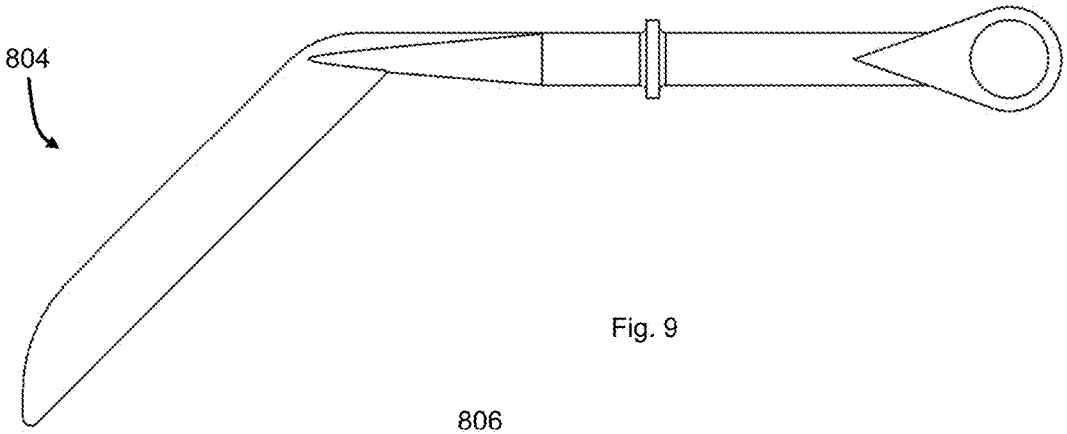
FIG. 9 is a side view of a knife tool that can be coupled to the housing of FIG. 4.
Figure 10:
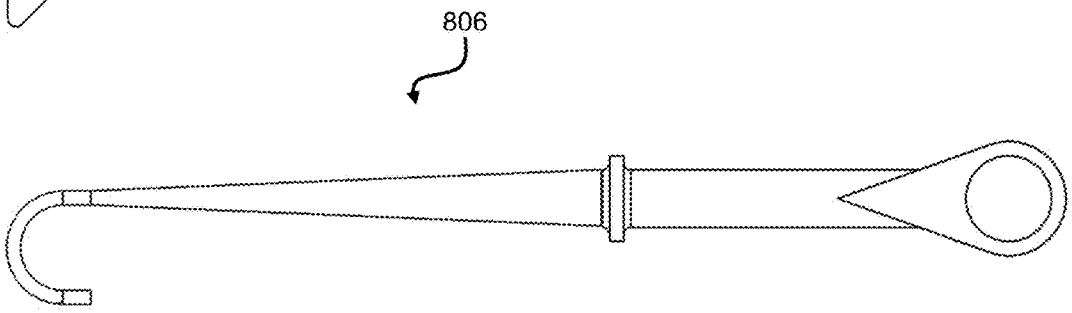
FIG. 10 is a side view of a scissor tool that can be coupled to the housing of FIG. 4.

Referring now to FIG. 1, one embodiment of a tool assembly 100 is shown. The tool assembly 100 may have a casing or housing body 102 that can be selectively coupled to a plurality of different tool modules (for different tool module types, see FIGS. 8, 9 and 10). The housing body 102 may have a top portion 106 and a bottom portion 108. In the embodiment shown in FIG. 1, a button module 104 is shown on a tool end 116 of the tool assembly 100.

In the embodiment shown in FIG. 1, the housing body 102 is substantially cylindrical in shape, but this disclosure is not limited to such a configuration. More specifically, the housing body 102 may be sized and shaped to be comfortably held and manipulated by a user. Accordingly, in addition to the cylindrical shape for the housing body 102 shown and described herein, this disclosure also considers any other size and shape that may increase the ergonomics of the housing body 102. In other embodiments, the housing body has a cross-section that is oval, square, rectangular, oblong, octagonal, or the like. Further still, in one embodiment the housing body is designed to specifically fit a particular user's hand. A person skilled in the art understands the particular size and shape of the housing body is variable and that the teachings of this disclosure are not limited to the size and shape of the housing body 102 shown in FIG. 1.

The embodiment of FIG. 1 also shows an opening 110 defined through an outer surface of the housing body 102. The opening extends from the top portion 106 and into the housing body 102 from the outer surface. In one non-exclusive example, the opening 110 extends at least partially through a center axis 112 defined longitudinally along the housing body 102. The opening 110 defines a substantially U-shaped cross-section when viewed from the top portion 106. Further, the opening 110 may be sufficiently wide to allow a module base 204 (FIG. 2) to become at least partially disposed therein. In the embodiment shown in FIG. 1, the opening 110 extends axially along the center axis 112 out of the top portion 106.

In one embodiment, the opening 110 includes a notch 114. The notch 114 may be defined along the inner surface of the opening 110 along a notch plane (not shown). Further, the notch plane may be perpendicular to the center axis 112. The notch 114 may be defined in the opening 110 at a location of the opening 110 biased towards the top portion 106. However, the notch 114 is not limited to being biased towards the top portion 106 and in other embodiments the notch 114 can be positioned along any portion of the opening 110. As will be described in more detail with reference to FIG. 2, the notch 114 may be sized to at least partially receive a collar 202 (FIG. 2) therein.

In the non-exclusive embodiment shown in FIG. 1, the button module 104 is shown having a finger hook 118, an eyelet 120, and inner sleeve 122, and an outer sleeve 124 as will be described with more detail with reference to FIGS. 6 and 7 below. The finger hook 118 shown in FIG. 1 is defined along a hook plane that is substantially perpendicular to the center axis 112 and this disclosure should not be limited to such an orientation. More specifically, the angular orientation of the finger hook 118 may be any orientation that allows a user to manipulate the finger hook 118 to actuate the button module 104. Accordingly, in another embodiment the finger hook 118 and the corresponding hook plane that is defined therethrough may be parallel to the center axis 112. Further still, any angular orientation of the finger hook 118 defining a hook plane between the perpendicular and parallel position relative to the center axis 112 is also considered herein. Accordingly, the positioning and angular orientation of the finger hook 118 is not limited to the embodiment shown in FIG. 1.

Figure 2:
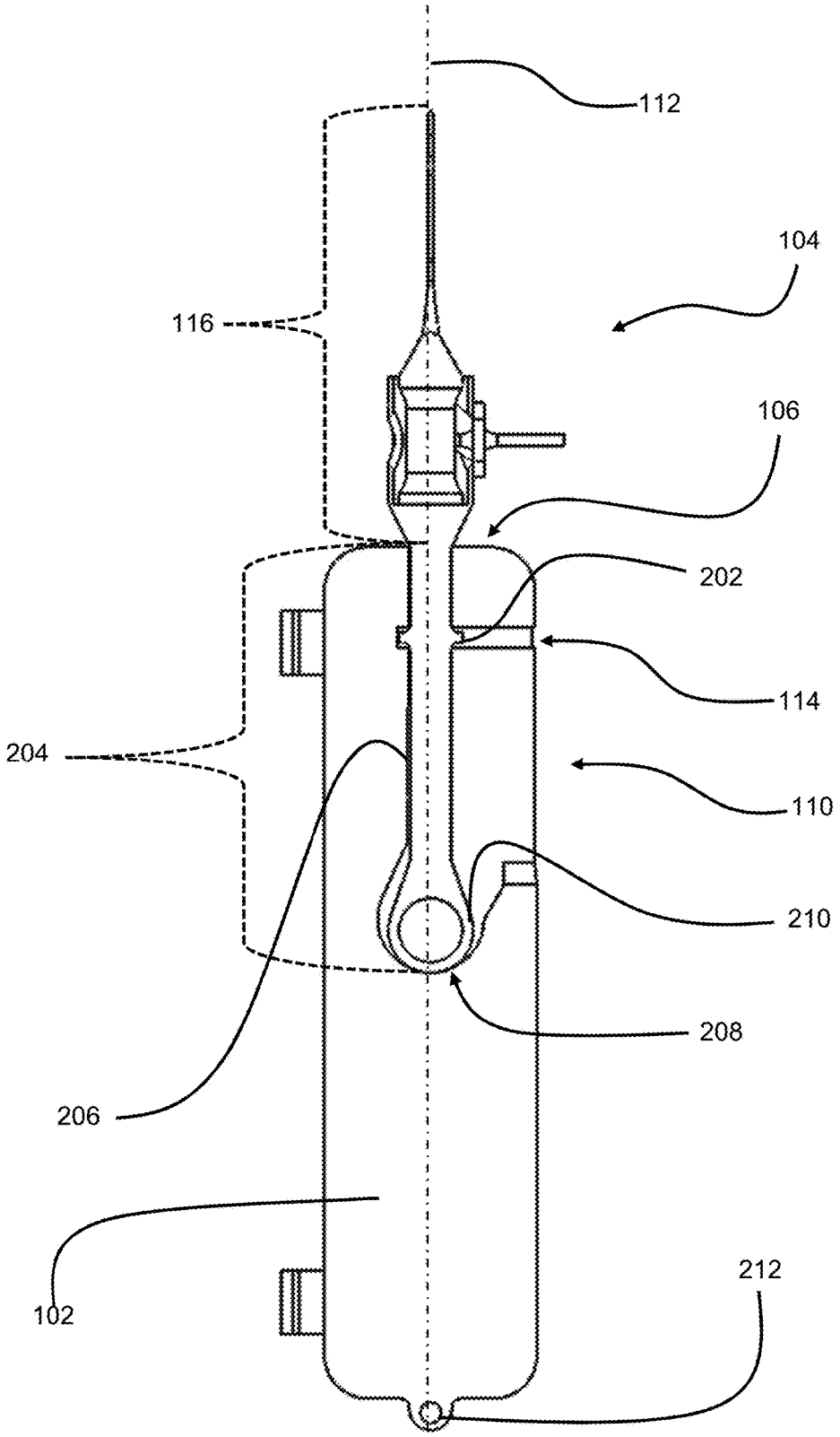
FIG. 2 is a longitudinal section view of the tool assembly of FIG. 1.

Referring now to FIG. 2, a cross-section view through the center axis 112 and the opening 110 is shown. Further, in the embodiment shown in FIG. 2 the module base 204 is shown coupled to the tool end 116 of the button module 104. The module base 204 is shown positioned in the opening 110 and aligned with the center axis 112.

While the embodiment of FIG. 2 shows the module base 204 aligned with the center axis 112, other alignment configurations between the module base 204 and the center axis 112 are also considered. More specifically, in other embodiments the module base 204 may define an axis that is parallel to, but offset from, the center axis 112. In yet another embodiment, the module base 204 may define an axis that is angularly offset from the center axis 112 at any angle. Accordingly, the particular alignment of the base module 204 relative to the center axis 112 and in turn the housing body 102 is not limiting.

In the embodiment shown in FIG. 2, the module base 204 may be positioned within the opening to contact a back portion 206 of the opening 110. The back portion 206 of the opening 110 may be sized to correspond with the module base 204 and thereby align the module base 204, and in turn the tool end 116, with the housing body 102. In the embodiment shown in FIG. 2, the back portion 206 aligns the module base 204 with the center axis 112 when the module base 204 is positioned adjacent to the back portion 206. However, as described above, the angular alignment of the module base 204 relative to the housing body 102 may vary. Accordingly, the position of the back portion 206 within the housing body 102 may also vary.

The embodiment of FIG. 2 also illustrates the collar 202 positioned within the notch 114. As described above, the collar 202 may fit within the notch 114 as the module base 204 is positioned within the opening 110. Further, when the module base 204 is positioned adjacent to the back portion 206, the collar 202 may substantially restrict the module base 204 from moving axially along the center axis 112. More specifically, any axial force applied to the module base 204 along the center axis 112 may cause the collar 202 to contact portions of the notch 114 and thereby restrict any substantial axial movement of the module base 204 relative to the housing body 102.

Also shown in the embodiment of FIG. 2 is a terminus 210 of the module base 204 positioned within a seat 208 defined in the housing body 102. The seat 208 may be a portion of the opening 110 that is substantially surrounded by the housing body 102 except in an axial direction along the center axis 112 towards the top portion 106. In other words, if the terminus 210 is positioned within the seat 208, the seat 208 will substantially restrict the terminus 210 from moving in directions perpendicular to the center axis 112. Accordingly, when the terminus 210 is positioned within the seat 208 and the collar 202 is positioned within the notch 114 (thereby restricting axial movement along the center axis 112), the terminus 210 may be restricted from any substantial movement through contact with the housing body 102.

Figure 3A:
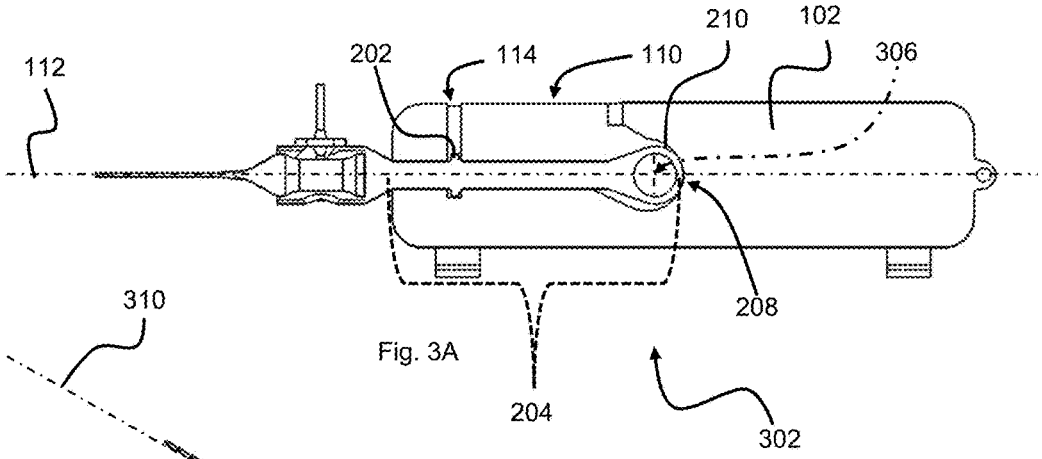
FIGS. 3A, 3B, and 3C are longitudinal section views showing a base module transitioning away from a housing.
Figure 3B:
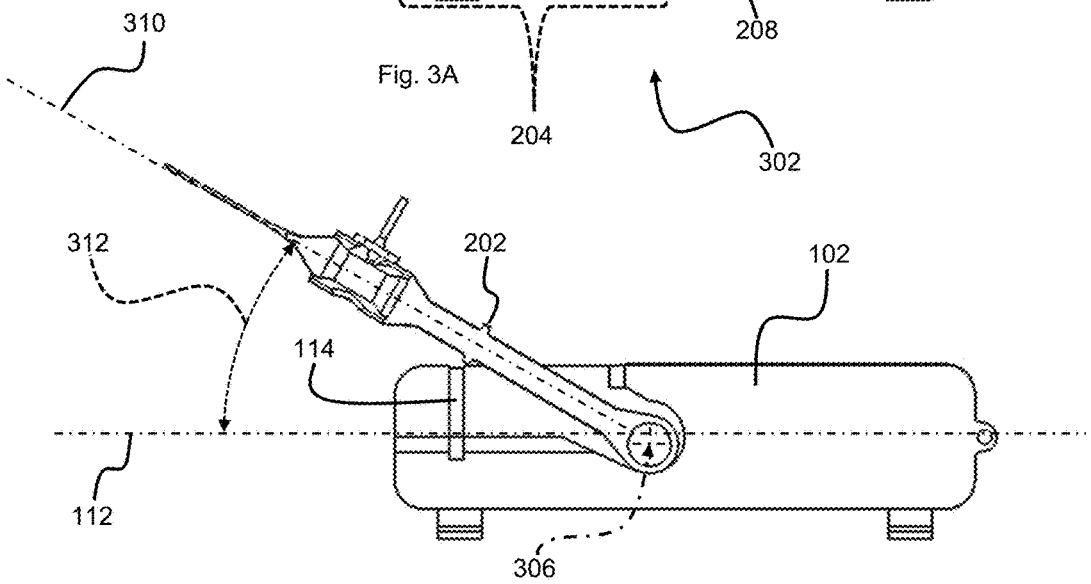
Figure 3C:
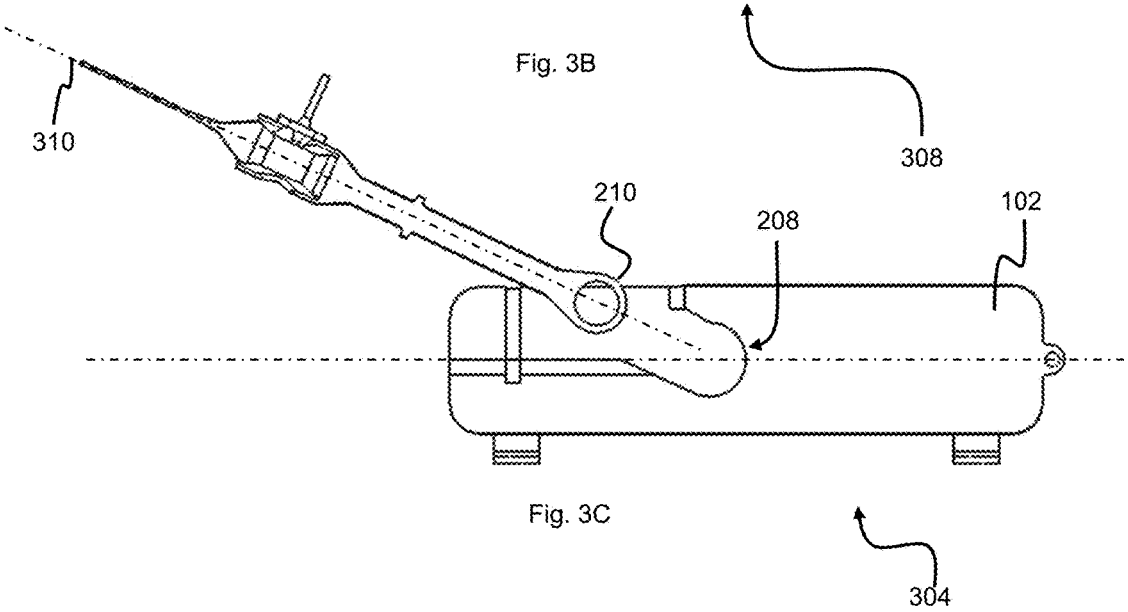

Now referring to FIGS. 3A, 3B, and 3C, one non-exclusive example of the button module 104 transitioning between a coupled position 302 and a released position 304 is shown. In the coupled position 302, as described above for FIG. 2, the collar 202 may be positioned within the notch 114 to substantially restrict axial movement of the module base 204 relative to the housing body 102 along the center axis 112. Further, the terminus 210 may be substantially maintained within the seat 208 as described above.

In one aspect of the present disclosure, the module base 204 may be substantially restricted from moving relative to the housing body 102 except for pivoting out of the opening 110 when the module base 204 is in the coupled position 302. More specifically, when the tool assembly 100 is in the coupled position 302, the module base 204 may rotate away from the housing body 102 through the opening 110 about a terminus axis 306. The terminus axis 306 may be defined by the terminus 210 and be substantially perpendicular to the center axis 112. To transition out of the coupled position 302, the collar 202 may slide within the notch 114 within the opening 110 as the module base 204 pivots away from the housing body 102 about the terminus axis 306.

In one aspect of the embodiment from FIGS. 3A, 3B, and 3C, the base module 204 may only be restricted to pivoting about the terminus axis 306 when the collar 202 is positioned within the notch 114. Further, in one aspect of the disclosure, a locking mechanism (not shown) may selectively restrict the module base 204 from pivoting about the terminus axis 306 when the tool assembly 100 is in the coupled position 302. The locking mechanism may be a Velcro strip that crosses the opening at the top portion 106 adjacent to the module base 204. Further still, another embodiment may position a stop within the opening to restrict the module base 204 from pivoting about the terminus axis 306 when in the coupled position 302. A person skilled in the art understands the module base 204 may be locked in the coupled position 302 by different mechanisms and this disclosure is not limited to any one mechanism.

Also shown in the embodiment of FIGS. 3A, 3B, and 3C is a cross-section view of the tool assembly 100 in an intermediate position 308. The intermediate position 308 may be one where the module base 204 has pivoted sufficiently away from the center axis 112 about the terminus axis 306 to position the collar 202 outside of the notch 114. More specifically, in the intermediate position 308, a module axis 310 defined through the module base 204 may be angularly offset from the center axis 112. In one aspect of the present embodiment, the module base 204 may be pivoted about the terminus axis 306 until the collar 202 is no longer positioned within the notch 114. In this non-exclusive example, a release angle 312 may be the angle between the module axis 310 and the center axis 112 at which the collar 202 has fully exited the notch 114. The release angle 312 may vary depending on the particular application and this disclosure is not limited to any one release angle 312. Rather, a person skilled in the art understands that the release angle varies based on the design of the housing body 102.

Another embodiment of FIGS. 3A, 3B, and 3C shows the tool assembly 100 in the released position 304. The released position 304 may be when the module base 204 has been pivoted to at least the release angle 312 and the module base 204 has been moved axially along the module axis 310 away from the seat 208. Once the module base 204 has been positioned in the released position 304, the module base 204 (and any tool coupled thereto) may be completely separated from the housing body 102.

While the embodiments of FIGS. 3A, 3B, and 3C have been shown and described above for transitioning tool assembly 100 from the coupled position 302 to the released position 304, the same teachings are equally applicable to transition the tool assembly 100 from the released position 304 to the coupled position 302. Accordingly, the above steps are considered equally applicable to coupling a module base 204 to the housing body 102 as well as for releasing the module base 204 from the housing body 102 albeit the steps are reversed.

Figure 4:
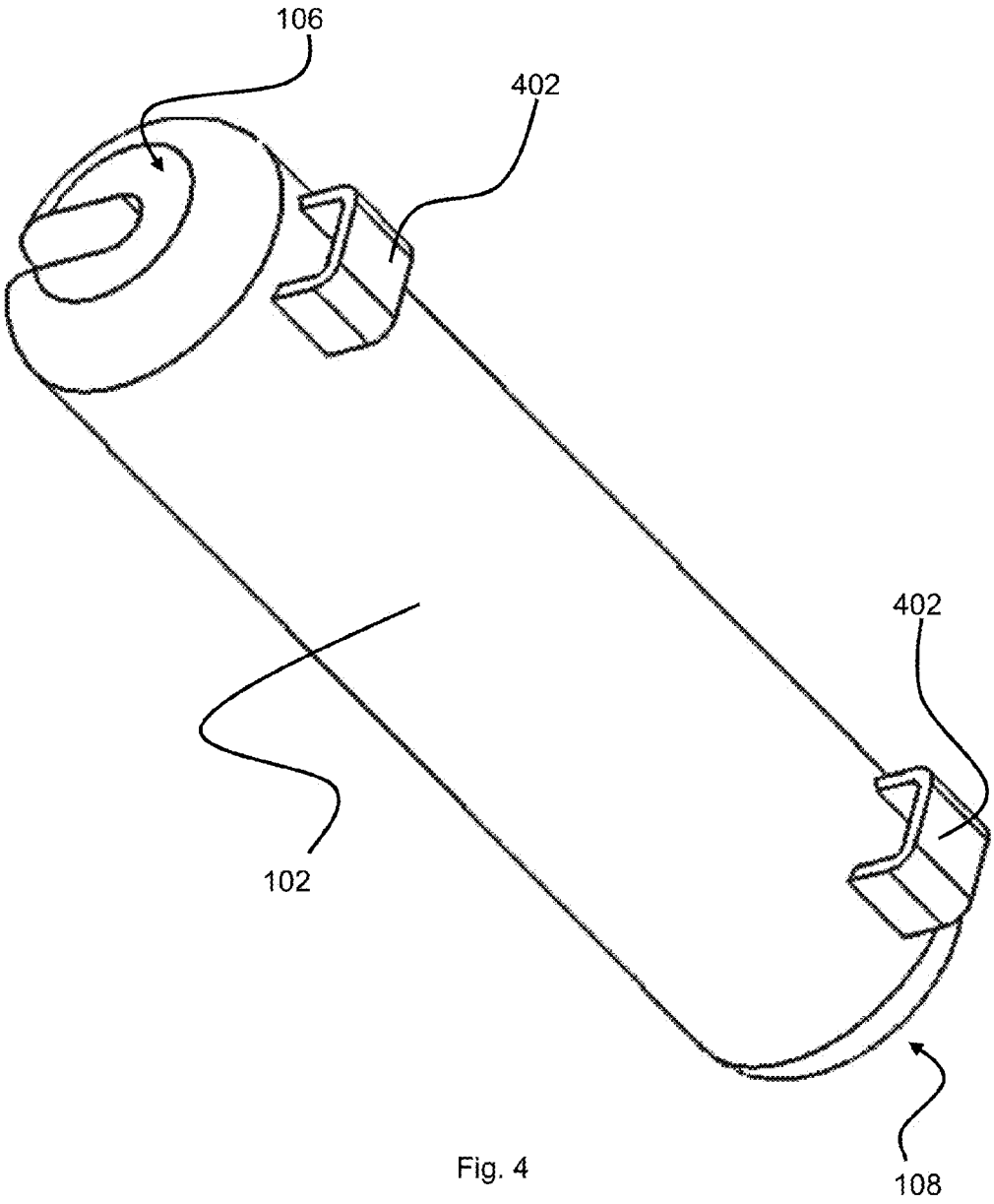
FIG. 4 is a perspective view of a housing of the tool assembly of FIG. 1.

Referring now to FIG. 4, one or more strap connections 402 are located along the outer surface of the housing 102. In one embodiment, a first strap connection 402 may be located towards the top portion 106 and a second strap connection 402 may be located towards the bottom portion 108. The respective strap connections 402 may provide a location for a strap to be coupled to the housing body 102. In one embodiment, a woven paracord strap may be coupled to each of the strap connections 402 to allow a user to position their hand between the strap and the housing body 102. In another embodiment, the strap connected between the respective strap connections 402 may have a latching mechanism that allows the strap to be detached from the respective strap connections 402.

While a paracord strap has been described herein, this disclosure is not limited to such a strap. Rather, other materials such as rubber, nylon, leather, neoprene, and the like can be used for a strap coupled to each of the strap connections 402. In yet another embodiment, there may be no strap connections 402 at all. In this embodiment, finger-sized through-holes may be integrally formed into the housing body 102 to provide a location for the user to position their fingers in order to manipulate the housing body 102. In yet another embodiment, there may be no straps or finger holes at all and the housing body 102 may be coated with a material that is easily held by the user.

Figure 5:
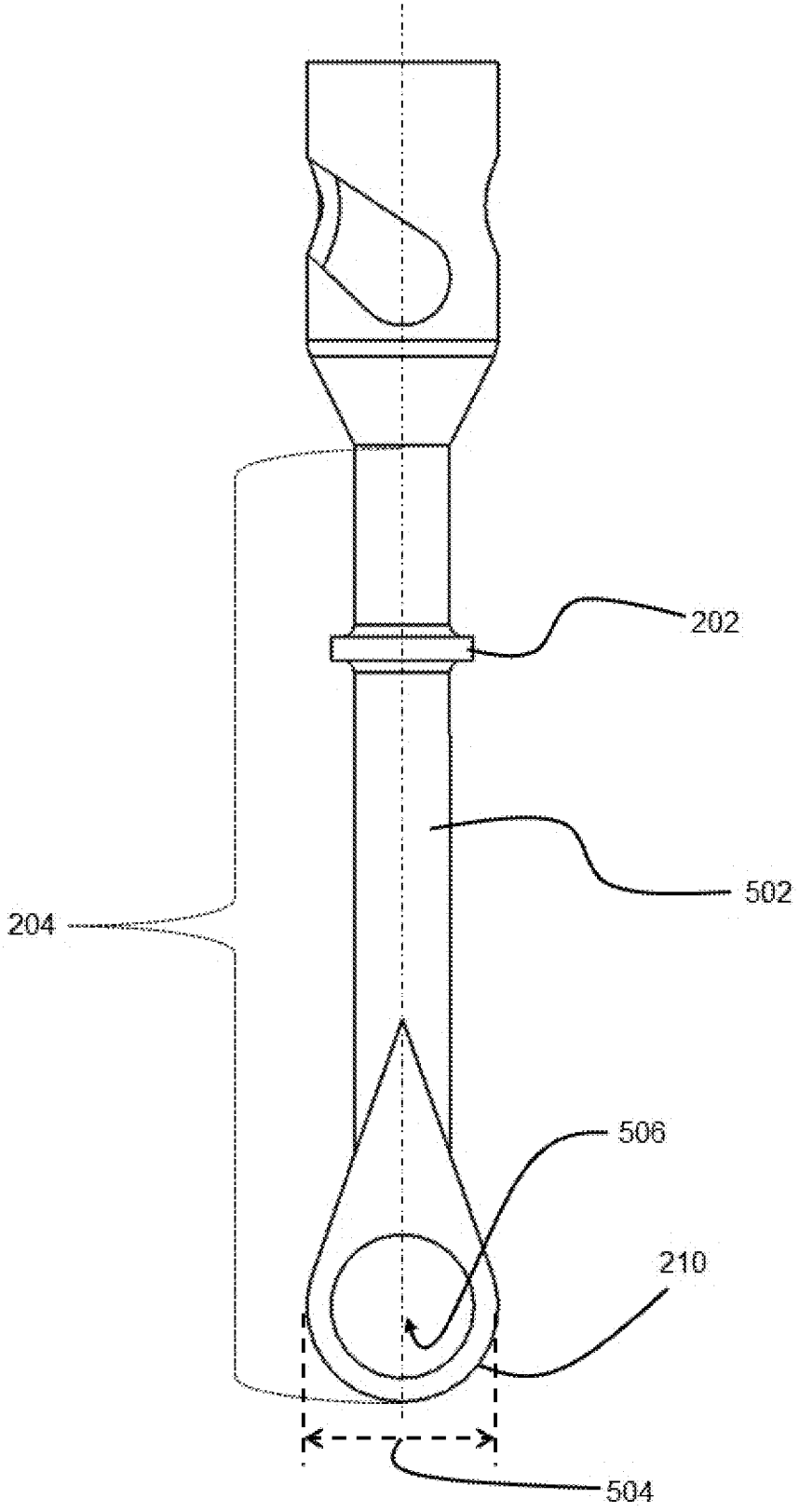
FIG. 5 is a side view of a base module of the tool assembly of FIG. 1.

Referring now to FIG. 5, one embodiment of the module base 204 is shown isolated from the housing body 102. As described above, the tool assembly 100 may utilize a plurality of tool modules that can be removably positioned within the housing body 102. In one aspect of the present disclosure, each tool module may have substantially the same module base 204 configuration. The module base 204 may have a substantially cylindrical shaft 502 that extends from the terminus 210 to a location passed the collar 202. While the shaft 502 is shown and described herein as being cylindrical, this disclosure is not limited to such geometry. Rather, in a different embodiment the shaft 502 may have a square, rectangular, oval, or the like shaped cross section. Accordingly, no single geometry for the shaft 502 is limiting.

In the embodiment shown in FIG. 5, the terminus 210 may have a width 504 that corresponds with the size of the seat 208. In one non-exclusive example, the width 504 is greater than the width of the shaft (not particularly shown). The width 504 of the terminus 210 may correspond with the size of the seat 208 to substantially restrict the module base 204 from rotating relative to the housing body 102 when the terminus 210 is positioned within the seat 208. More specifically, while the shaft 502 has been described as substantially cylindrical, the terminus 210 has at least one defining feature that will bind with the seat 208 to restrict rotation along the center axis 112 relative to the housing body 102 when positioned within the seat 208.

In the embodiment shown in FIG. 5, the terminus 210 may be defined by two substantially planar faces spaced from one another. The planar faces of the terminus 210 may correspond with planar faces defined in the seat 208 to contact one another when a torque is applied to the module base 204. The contact between the terminus 210 and the seat 208 may be sufficient to resist any substantial rotation of the module base 204 relative to the housing body 102 along the center axis 112.

In yet another aspect of the present disclosure, the terminus 210 may define a keyhole 506 therethrough. The keyhole 506 may provide a location to couple the module base 204 (and in turn the respective tool module) to a retention ring (not particularly shown). The retention ring may be removably coupled to the housing body 102 at the strap connection 402 or at a separate retention ring connection 212 (FIG. 2). The retention ring may be sized to become selectively positioned through the key hole 506 to couple the module base 204 to the retention ring connection 212 when the particular tool module is not being used in the opening 110. In one embodiment, multiple tool modules may be coupled to the housing body 102 through the retention ring while a separate tool module is in the opening 110. This configuration allows the user to transition between the tool modules being used.

Figure 6:
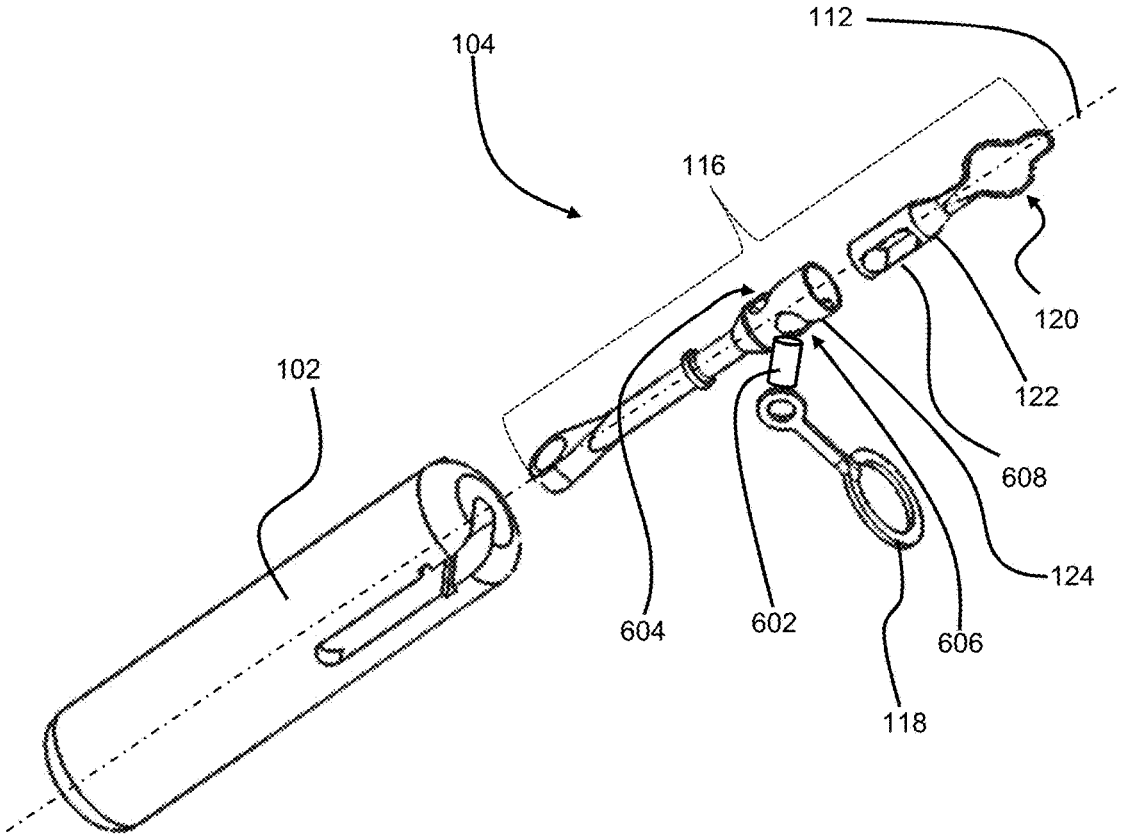
FIG. 6 is a perspective exploded view of the tool assembly of FIG. 1.

Referring now to the embodiment shown in FIG. 6, the tool end 116 of the button module 104 is shown in exploded form. The outer sleeve 124 of the button module 104 has an inner diameter that is slightly greater than the outer diameter of the inner sleeve 122. More specifically, the inner sleeve 122 is sized to fit within the outer sleeve 124. The outer sleeve 124 may also have a rear track 604 and a front track 606 defined therethrough. The front and rear track 604, 606 may be slotted elongated through-holes that are defined diagonally along the outer sleeve 124. Further, the inner sleeve 122 may define an elongated through-hole 608 therein. The elongated through-hole 608 is elongated axially along the center axis 112 within the inner sleeve 122. Further, the elongated through-hole 608 may have a lower wall at the portion of the elongated through-hole 608 that is axially distal from the eyelet 120 and an upper wall at a portion that is axially proximate to the eyelet 120.

When the inner sleeve 122 is positioned within the outer sleeve 124, the inner sleeve 122 may rotate and move axially about the center axis 112 relative to the outer sleeve 124. However, when the inner sleeve 122 is positioned within the outer sleeve 124, a pin 602 is positioned through the front track 606, the elongated through-hole 608, and the rear track 604 to slidably couple the inner sleeve 122 to the outer sleeve 124. The pin 602 may be flared (not shown) at the end proximate to the rear track 604 and coupled to the finger hook 118 at the end proximate to the front track 606 thereby maintaining the pin's 602 position within the respective tracks 604, 606 and the elongated through-hole 608.

While in the embodiments shown and described herein the pin 602 is an independent component, in other embodiments the pin 602 may be integrally formed with the finger hook 118. In this embodiment, the pin feature may be integrally formed into the finger hook 118 and may be positioned through the respective tracks 604, 606 and the elongated through-hole 608. A flared cap or other similar fastener may be coupled to a distal end of the pin feature. Accordingly, the pin feature of the finger hook 118 may be substantially restricted from moving out of the respective tracks 604, 606 and the elongated through-hole 608 because the flared portion of the cap or other fastener is unable to pass therethrough.

Figure 7A:
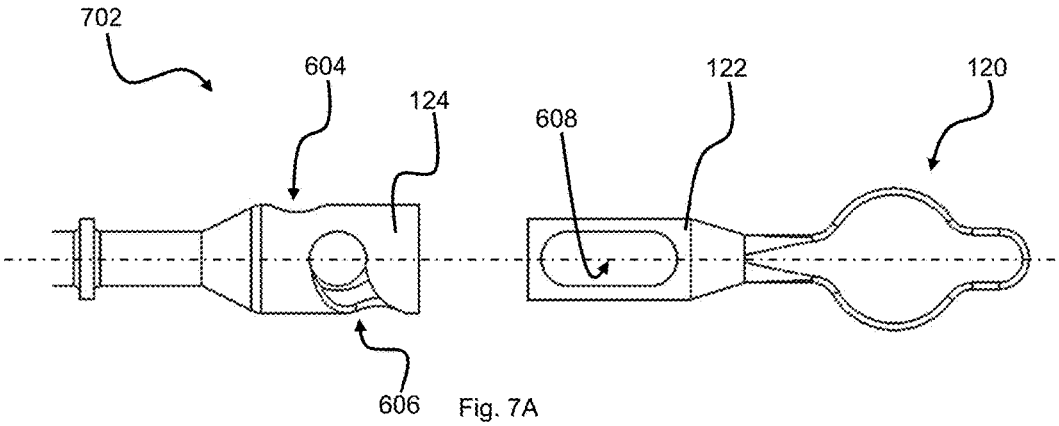
FIGS. 7A, 7B, and 7C are exploded views of a tool end of a button module as it rotates along an axis.
Figure 7B:
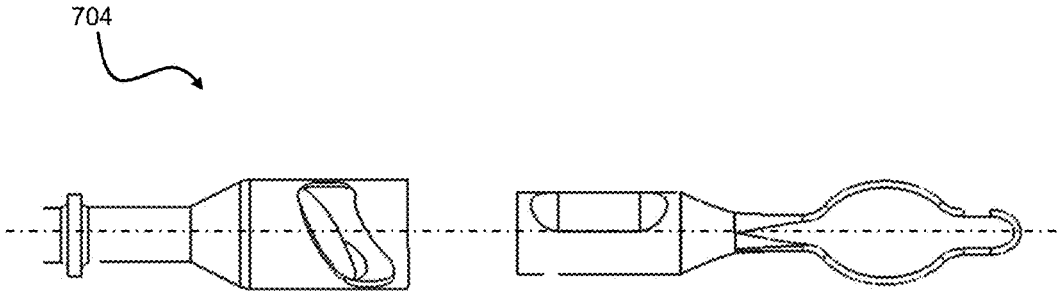
Figure 7C:
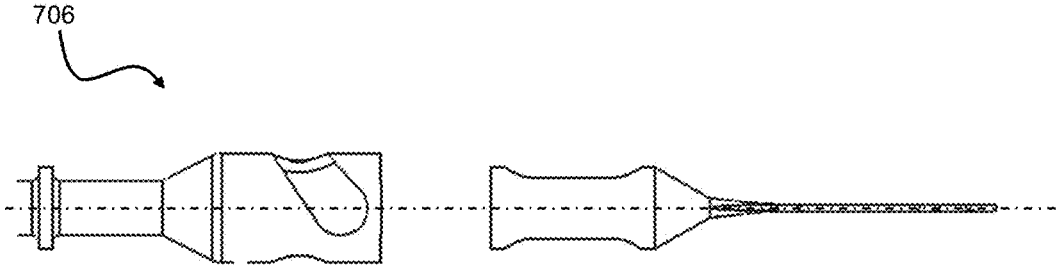

Referring now to the embodiment shown in FIGS. 7A, 7B, and 7C, the outer sleeve 124 and the inner sleeve 122 are shown at neutral rotation 702, half rotation 704, and full rotation 706. At neutral rotation 702, the front track 606 may be aligned with the rear track 604 so the pin 602 can be positioned therethrough substantially perpendicular to the center axis 112. That is to say, in the neutral rotation 702, the user has manipulated the finger hook 118 to position the pin perpendicular to the center axis 112 through the respective tracks 604, 606 and the elongated through-hole 608.

If the user continues to manipulate the finger hook 118, the pin 602 may become disposed along the front and rear tracks 606, 604 at a location between the neutral rotation 702 and the full rotation 706. When the pin 602 is positioned through the front and rear tracks 606, 604 in the half rotation 704, the pin 602 may no longer be perpendicular to the center axis 112. More specifically, the front track 606 may bias the pin 602 towards the eyelet 120 while the rear track 604 may bias the pin 602 away from the eyelet 120. Accordingly, not only does the pin 602 rotate about the center axis 112 as it moves from the neutral rotation 702 to the half rotation position 704, the pin 602 also becomes angled relative to the center axis 112.

Finally, in the full rotation position 706, the pin 602 may have rotated about 90 degrees about the center axis 112 compared to the neutral rotation 702. The full rotation position 706 may also cause the pin 602 to be at a maximum angular disposition relative to the center axis 112. In other words, when the pin 602 is in the full rotation position 706, the pin 602 angle may be at a maximum angle relative to the center axis 112. In the full rotation position 706, the pin 602 is positioned in the front track 606 at a location that is axially towards the eyelet 120 while the portion of the pin 602 that is in the rear track 604 is at a location that is axially away from the eyelet 120.

When the button module 104 is in the coupled position 302 as shown in the embodiment of FIG. 1, the user may manipulate the finger hook 118 to articulate the eyelet 120 to facilitate buttoning a garment or other device. More specifically, the user may position the eyelet through a button hole and allow a button to pass through a larger diameter portion of the eyelet 120. The user may then begin to withdraw the eyelet 120 through the button hole while retaining the button within the smaller diameter portion of the eyelet 120. As the button becomes positioned proximate to the button hole, the user may begin manipulating the finger hook 118 to articulate the inner sleeve 122, and in turn the eyelet 120, as described above. By manipulating the finger hook 118, the eyelet 120 will both rotate about the center axis 112 and move axially therealong. The rotation and axial movement of the eyelet allows the user to properly pass the button through the button hole. Once the button has passed through the button hole, the user may transition the tool assembly 100 so the larger portion of the eyelet 120 is positioned around the button to be removed therefrom.

While a button module 104 has been described in detail herein, this disclosure is not limited to the button module 104 being coupled to the tool end 116. Rather, other tools may have a tool end 116 and a module base but for a different purpose. In the non-exclusive examples shown in FIG. 8, a scissor module 802, knife module 804, or zipper module 806 may be utilized on the tool end 116. In yet another embodiment, the tool end 116 may be a snap assembly. Any type of tool can be coupled to the tool end and this disclosure is not limited to any particular type of tool.

While exemplary embodiments incorporating the principles of the present disclosure have been disclosed hereinabove, the present disclosure is not limited to the disclosed embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A tool assembly, comprising:

a housing body having a top portion and a bottom portion;

an axis defined by the housing body and extending through the top portion and the bottom portion;

an opening defined in the housing body and extending from an outer surface of the housing body towards the axis;

a notch defined in the housing body along the opening; and a seat defined by the housing body as part of the opening, the seat being encompassed by the housing body except axially towards the top portion;

wherein, the opening is sized to receive a module base having a collar;

further wherein, the collar is at least partially positioned within the notch when the module base is positioned within the opening;

further wherein, the notch restricts the module base from moving axially along the axis relative to the housing body through contact with the collar.

2. The tool assembly of claim 1, further comprising a terminus defined by the module base, wherein when the collar is at least partially positioned within the opening and the terminus is positioned within the seat, the terminus is substantially restricted from moving relative to the housing body.

3. The tool assembly of claim 2, wherein the module base further comprises a substantially cylindrical shaft extending between the terminus and the collar.

4. The tool assembly of claim 3, wherein the terminus has a second maximum width;

further wherein, when the terminus is positioned within the seat, the terminus interferes with the seat to substantially restrict the module base from rotating along the axis relative to the housing body.

5. The tool assembly of claim 1, further comprising a keyhole defined in the module base at a terminus.

6. The tool assembly of claim 1, further comprising a tool coupled to the base module, wherein the tool is one of a knife, a zipper hook, a scissor assembly, or a button hook assembly.

7. A tool system comprising:

a housing defining an axis that extends longitudinally through a top and a bottom of the housing;

an opening defined in the housing biased towards the top;

a receiver defined by the housing between the opening and the bottom;

a notch defined in the opening between the receiver and the top; and a tool having a module base that defines a collar and a terminus;

wherein, the terminus is positionable within the receiver;

further wherein, the collar is positionable at least partially within the notch;

further wherein, when the collar is at least partially within the notch and the terminus is at least partially within the receiver, the tool is restricted from moving axially along the axis relative to the housing.

8. The tool system of claim 7, wherein the terminus defines a keyhole.

9. The tool system of claim 7, further wherein when the terminus is at least partially received within the receiver, the module base does not rotate about the axis relative to the housing.

10. The tool system of claim 7, further comprising a locking mechanism selectively positionable across the opening.

11. The tool system of claim 7, further wherein, the terminus is positioned at least partially within the receiver before the collar is positioned at least partially within the notch to couple the tool to the housing within the opening.

12. The tool system of claim 7, further comprising one or more strap connection coupled to the housing, the strap connection providing a location for one or more strap to be coupled to the housing.

13. The tool system of claim 7, wherein the tool defines the module base on one side, and a button module on the other side, the button module comprising:

an outer sleeve coupled to the base module;

a front track and a rear track defined through the outer sleeve;

an inner sleeve sized to he slidably positioned within the outer sleeve;

an elongated through-hole defined through a portion of the inner sleeve;

an eyelet coupled to the inner sleeve;

a pin positioned through the front track, the elongated through-hole, and the rear track; and a finger hook coupled to one end of the pin;

wherein, the finger hook is adapted to move the pin along the first track and the second track.

14. A tool for positioning a button through a button hole, the tool comprising:

a base module on a first side of the tool and a button module on a second side of the tool, the second side of the tool being opposite the first side of the tool;

an outer sleeve coupled to the base module and defining a track therein;

an inner sleeve sized to be slidably positioned within the outer sleeve and defining an elongated through-hole therein;

a finger hook configured to be slidably received by the track and the elongated through-hole; and an eyelet coupled to the inner sleeve.

15. The tool of claim 14, further comprising an axis defined through the base module.

16. The tool of claim 15, further comprising:

a pin positioned through the track and the elongated through-hole;

wherein, the elongated through-hole defines an upper wall and a lower wall;

further wherein, the inner sleeve is configured to move axially along the axis until the pin contacts the upper wall or the lower wall of the elongated through-hole.

17. The tool of claim 16, wherein as the pin moves along the track, the inner sleeve rotates about the axis relative to the outer sleeve.

18. The tool of claim 14, wherein the eyelet includes a large section coupled to small section, wherein the large section is sized to fit around the button and the small section is sized to become located underneath the button during movement of the eyelet with respect to the button.

19. The tool of claim 14, wherein the base module comprises:

a housing body having a top portion and a bottom portion;

an axis defined by the housing body and extending through the top portion and the bottom portion;

an opening defined in the housing body and extending from an outer surface of the housing body towards the axis;

a notch defined in the housing body along the opening;

a module base having a collar;

wherein, the module base is positionable within the opening;

further wherein, when the collar is at least partially positioned within the notch, the module base is at least partially positioned within the opening and restricted from moving axially along the axis relative to the housing body.

* * * * *